United States Patent [19]

Halliday, Jr.

[11] 4,122,510

[45] Oct. 24, 1978

[54] FLASHLIGHT

[75] Inventor: Richard L. Halliday, Jr., Fountainville, Pa.

[73] Assignees: S. Harry Fazzina; Roberta A. Fazzina, both of Wyndmoor, Pa.

[21] Appl. No.: 746,637

[22] Filed: Dec. 1, 1976

[51] Int. Cl.[2] ..... F21V 9/16

[52] U.S. Cl. ..... 362/189; 362/201; 362/202

[58] Field of Search ..... 240/10.65, 10.6 R, 10.66; 362/189, 200, 201, 202

[56] References Cited

U.S. PATENT DOCUMENTS

| | | | |
|---|---|---|---|
| 3,256,428 | 6/1966 | Schwartz | 240/10.65 |
| 3,758,773 | 9/1973 | Nau | 240/10.6 R |
| 3,796,869 | 3/1974 | Stone | 240/2.25 |
| 4,032,773 | 6/1977 | Halliday, Jr. et al. | 240/10.6 R |

FOREIGN PATENT DOCUMENTS

| | | | |
|---|---|---|---|
| 1,443,787 | 12/1966 | France | 240/10.65 |

*Primary Examiner*—Samuel W. Engle

*Assistant Examiner*—Ralph Palo

*Attorney, Agent, or Firm*—Ferrill and Logan

[57] ABSTRACT

A flashlight in accordance with the preferred embodiment of the invention includes a housing enclosing an insulating battery retaining member formed with spring arms for retaining a pair of batteries in spaced-apart relationship. Further included is a light bulb having a pair of leads extending therefrom and carried at one end of the housing with the leads each connected to a battery. Adjacent the opposite end of the housing a conductive switch member is frictionally retained on the positive post of one battery and extends between the battery retaining member and a flexible wall of the housing. The other end of the switch member is located adjacent a cutout portion of the battery retaining member which exposes a conductive surface of the other of the batteries so that when the flexible wall of the housing is pressed the other end of the switch wire contacts the other of the batteries completing a circuit between the batteries and the light bulb. Stop members are formed on the battery retaining member and retain the batteries against axial movement.

7 Claims, 4 Drawing Figures

FIG. 1

FLASHLIGHT

Figure 1:
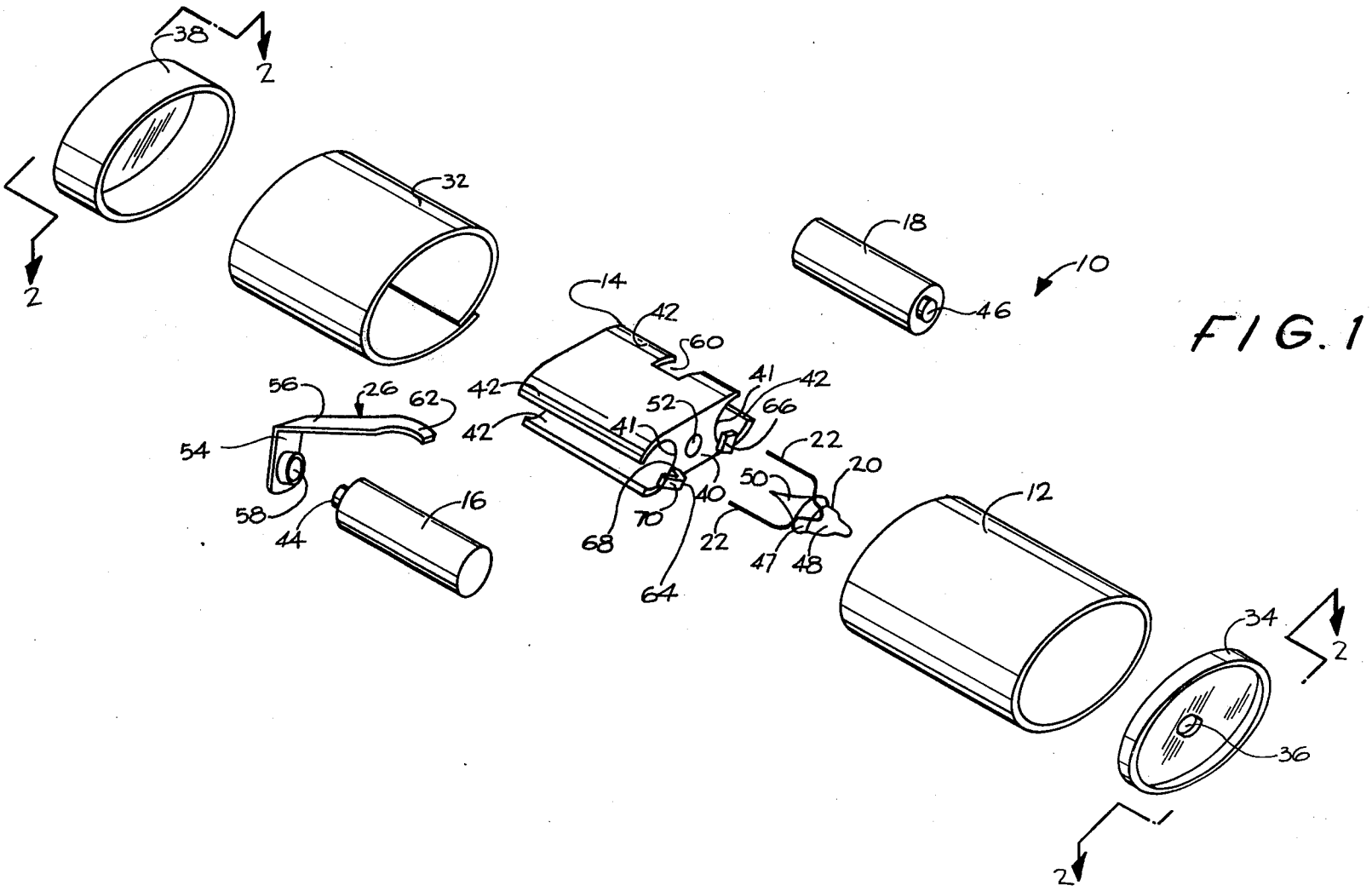

This invention relates to flashlights and, more particularly, to relatively small, inexpensive flaslights easily carried in a purse or pocket. One currently available flashlight of this type is generally similar to that disclosed in U.S. Pat. No. 3,796,869, issued Mar. 12, 1974 to W. S. Stone and comprises a housing having a flexible wall in which is carried a battery holder formed with shallow channels in which a pair of batteries are adhesively secured. A light bulb is carried at one end of the housing and includes lead wires extending from the bulb which are soldered to one end of the batteries. One end of a conductive switch wire is soldered to the other end of one of the batteries and the switch wire is arranged to be adjacent to, but normally spaced from, an exposed conductive surface of the other battery. When it is desired to light the bulb, the outer flexible wall of the housing is pressed or squeeezed causing the other end of the switch wire to contact the exposed surface of the other battery completing the circuit between the batteries and the bulb. While the flashlight described is generally satisfactory in use, it is time consuming and, thus, expensive to manufacture.

Accordingly, it is an object of this invention to provide a small, easily carried flashlight that is relatively inexpensive.

It is another object of this invention to provide a small flashlight that is easily assembled.

It is yet another object of this invention to provide a small flashlight including economical battery holding means and switch means.

Finally, it is an object of this invention to provide a small flashlight that is relatively simple, rugged and easy to use.

These and other objects of this invention are accomplished by providing a flashlight comprising a housing having a generally flexible side wall, an insulating battery retaining member located in the housing and formed with resilient arm members which retain a pair of batteries having exposed conductive surfaces. At one end of the housing is carried a light bulb having leads extending therefrom and each of the leads is in contact with a battery. Frictionally retained on one of the batteries is a conductive switch member that extends from the one battery between the battery retaining member and the flexible side wall of the housing. The switch member terminates adjacent a cutout portion of the battery retaining member which exposes a conductive surface of the other battery.

More particularly, the switch member is formed of a flat piece of material bent adjacent one end to provide a long leg portion and a short leg portion, the latter formed with an opening which is placed over the positive post of the one battery and frictionally retained thereon. The long leg portion extends from the short leg portion to the cutout portion of the battery retaining member.

Further, there is provided a pair of stop members formed of insulating material and bearing on the ends of the batteries adjacent the one end of the housing to retain the batteries against movement in one direction along the housing.

Figure 3:
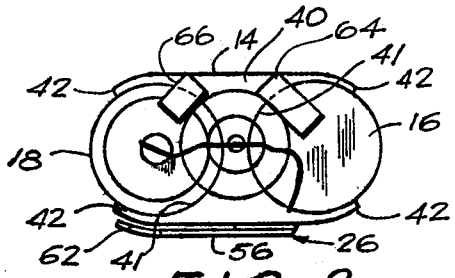
Figure 4:
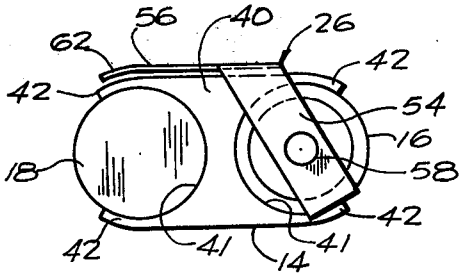
Figure 2:
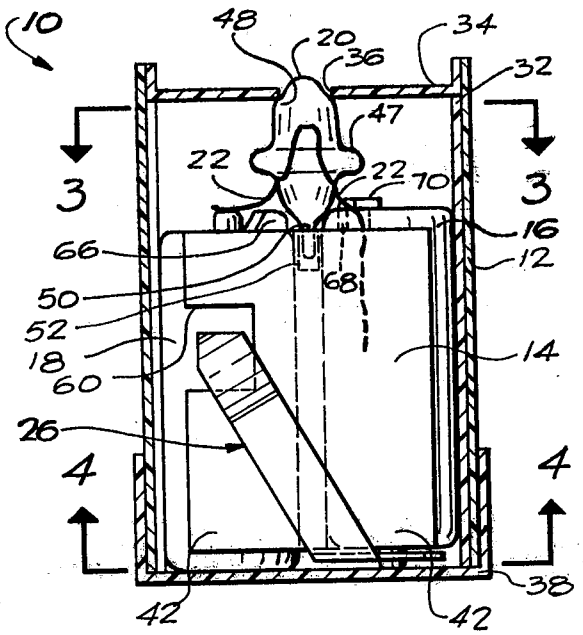

For a better understanding of the invention, reference is made to the following description of a preferred embodiment thereof taken with the figures of the accompanying drawing, in which:

FIG. 1 is an exploded perspective view of a flashlight in accordance with this invention;

FIG. 2 is a partial sectional view of the flashlight illustrated in FIG. 1 shown in assembled condition; and, FIGS. 3 and 4 are sectional views of the flashlight with the housing omitted for the sake of clarity and taken generally along the lines 3—3 and 4—4, respectively, of FIG. 2.

Referring now to the drawing, there is illustrated a flashlight 10 comprising a housing with a generally flexible side wall 12 in which is carried a battery retaining member 14 for a pair of batteries 16 and 18 having exposed conductive surfaces. One end of the housing carries a light bulb 20 including lead wires 22, 22 extending from the filament into conducting relationship with the batteries 16 and 18. A switch member 26 is frictionally retained with the battery 16 and extends upwardly along the outer surface of the battery retaining member 14 adjacent the side wall 12 and terminates adjacent a cutout portion of the retaining member formed adjacent to an exposed conductive surface of the battery 18.

As noted above the housing includes a generally flexible side wall 12 which in the preferred embodiment disclosed herein comprises the outer wall member of the housing and surrounds a flexible inner wall member 32. Both wall members are generally rectangular pieces of plastic, coated paper or some other similar flexible insulating material and are shaped to define a generally oval cross-sectional cavity. The outer wall member 12 is preferably transparent and the inner wall member 32 is opaque and may include indicia of any desired type, for example, advertising material. At the end of the wall members 12 and 32 adjacent the light bulb 20 there is provided a generally oval end wall member 34 adapted to seat against the inner surface of the outer wall member 12 and on the end of the inner wall member 32. The end wall member 34 is retained in position by friction, or adhesives, can be heat fused or retained in any other desirable manner. An opening 36 is centrally formed in the end wall member and the light bulb 20 is adapted to project through the opening. If desired, the top outer surface of the end member 34 may be coated with a reflective material for dispersing and reflecting the light from the light bulb 20. The other end of the inner and outer wall members 12 and 32, respectively, is received in an end closure member or cup 38 which is retained in place by friction or adhesives, can be heat fused or retained in any other desirable manner.

The battery retaining member 14 is located inside the generally oval cavity, is formed of plastic or a similar resilient insulating material and comprises a central body portion 40 extending longitudinally along the axis of the flashlight 10. Opposite sides of the body portion 40 are formed with arcuate surfaces 41 which provide a seat for the batteries 16 and 18. For retaining the batteries 16 and 18 in the seats 41, a pair of generally arcuate resilient arms 42 extend from each of the opposite sides of the body portion 40 and form with the adjacent seat 41, a channel having an arcuate length greater than one-half the circumference of a battery. The resilient arms 42 are generally elongated extending throughout the length of the body portion 40 and the longitudinal ends of each arm in a pair are spaced apart a sufficient distance to allow insertion of a battery.

The batteries 16 and 18 are generally conventional dry cell batteries without an insulating wrapper around the outer surface or casing so that the conductive cylindrical wall is exposed. The batteries are arranged in the retaining member 14 so that the flat end wall of the battery 16 is adjacent the end wall member 34 and the positive post 44 is adjacent the cup 38 and so that the flat end wall of the battery 18 is adjacent the cup 38 and the positive post 46 is adjacent the end wall member 34.

The light bulb 20 is generally conventional and has a dome portion 48, an enlarged diameter portion 47 and a reduced diameter tip portion 50 which seats in a locating opening 52 in an end wall of the body portion 40. The dome portion 48 extends through the opening 36 in the end wall member 34. As best seen in FIG. 2 of the drawing one of the lead wires 22 is soldered to the positive post 46 of the battery 18 and the other of the lead wires 22 is retained between the conductive cylindrical wall of the battery 16 and a resilient arm 42 adjacent that battery. Because the resilient arms 42 retain the batteries in contact with their adjacent seat 41, a retaining force maintains conducting contact between the battery 16 and its associated lead wire 22.

The switch member 26 is formed from a flat elongated piece of electrically conductive material, for example, any suitable metal, and, accordingly, has a measurable length and width. The flat piece of material is bent adjacent one end so that it includes a short leg portion 54 and a long leg portion 56 forming a right angle in the side view, but extending at an obtuse angle in the front view. The short leg portion 54 is formed with a small aperture 58 which frictionally fits over the positive post 44 of the battery 16. Preferably, the aperture 58 is formed by a suitable piercing tool so that a small cylindrical sleeve extends from the surface of the short leg portion 54 in the direction of the long leg portion 56 and the sleeve frictionally grips the positive post 44. Since the long leg portion 56 extends, in the front view, at an obtuse angle to the short leg portion 54, it extends between the battery retaining member 14 and the inner surface of the inner wall member 32 toward the battery 18 and terminates in a free end adjacent a cutout portion 60 formed in the one of the arms 42. Thus the free end of the long leg portion 56 is adjacent an exposed conductive surface of the battery 18 and is normally spaced therefrom by the thickness of the arm 42. If desired the free end can be formed with a tongue 62 extending away from and then toward the exposed conductive surface of the battery 16.

When the flashlight is assembled and when it is desired to light the light bulb 20, it is merely necessary to squeeze the opposite sides of the outer wall member 12. The force thus exerted moves the inner wall member 32 toward the batteries 16 and 18 exerting force on the switch member 26 whereby the free end of the long leg portion 56 contacts the exposed conductive surface of the battery 18 completing the electrical circuit between the batteries 16 and 18 and energizing the light bulb 20.

At the end of the battery retaining member 14 adjacent the end wall member 34 there is provided a pair of stop members 64 and 66 formed integral with the body portion 40. The stop member 64 is generally L-shaped including a first leg portion 68 projecting outwardly of the body portion in a direction parallel to the battery 16 and also including a second leg portion 70 extending across a portion of the channel formed by the seat 41 and arms 42, 42 in which the battery 16 is received. The second leg portion 70 thus bears on the flat end wall of the battery 16 and prevents axial movement of that battery toward the light bulb 20. With such movement of the battery 16 thus prevented the switch member 26 cannot be inadvertently disengaged from the positive post 44 of the battery.

The stop member 66 comprises a single leg portion extending across the channel formed by the seat 41 and arms 42, 42 in which the battery 18 is received. This single leg portion thus bears on the end of the cylindrical wall of the battery 18 adjacent the positive post 46 and prevents axial movement of that battery toward the light bulb 20. With such movement of the battery 18 thus prevented the lead wire 22 soldered to the positive post 46 cannot inadvertently short out.

At this point it is noted that the cylindrical wall of the batteries 16 and 18 have a larger axial length than that of the body portion 40 and arms 42, 42. Accordingly, a portion of the cylindrical wall and the flat end wall of the battery 18 project beyond the end of the battery retaining member 14 adjacent the cup member 38 and the flat end wall of that battery member bears on the inner surface of the cup member. It is also noted that the length of the first leg portion 68 of the stop member 64 is such that a portion of the cylindrical wall and flat end wall of the battery 16 project beyond the end of the battery retaining member 14 adjacent the wall member 34. The length of the projection of the cylindrical wall of the battery 16 is equal to the length of the projection of the cylindrical wall of the battery 18 so that the end of the positive post 44 lies in the same plane as the end wall of the battery 18. Accordingly, the inner surface of the cup member 38 bears on the flat end wall of the battery 18 and the end of the positive post 44 and is maintained in a level orientation on the side wall 12.

While in the foregoing, a preferred embodiment of the invention has been described, it should be understood to one skilled in the art that various modifications and changes can be made without departing from the true spirit and scope of the invention as recited in the appended claims.

I claim :

1. A flashlight comprising a housing having a generally flexible side wall, a first end wall and a second end wall having a central opening therein; an insulating battery retaining member including resilient arm members retaining a pair of batteries having exposed conductive surfaces, one end of one of said batteries projecting beyond the end of said battery retaining member adjacent said second end wall with its positive post extending beyond the end of said battery retaining member adjacent said first end wall, one end of the other of said batteries projecting beyond the end of the battery retaining member adjacent the first end wall with the positive post thereof projecting beyond the end of said battery retaining member adjacent said first end wall whereby, the positive post of said one battery and the end of said other battery bear on said first end wall; a light bulb at the end of said housing adjacent said second end wall with a portion of said light bulb extending through said central opening, said light bulb being electrically connected to said batteries; a pair of stop members formed on said battery retaining member at the end thereof adjacent said second end wall, each stop member bearing on the end of a battery member for preventing movement of said battery members toward said second end wall; and a conductive switch member frictionally retained on said positive post of said one of said batteries, said switch member including a portion extending between said flexible side wall and said battery retaining member and terminating adjacent a cutout portion of said battery retaining member exposing a conductive portion of the other of said batteries whereby said switch member completes a circuit between said batteries and said light bulb when force is applied to the flexible side wall.

2. A flashlight in accordance with claim 1 wherein said switch member comprises a flat elongated member bent adjacent one end to include a short leg portion having an aperture therein, which frictionally fits over said positive post of said one of said batteries.

3. A flashlight in accordance with claim 2 wherein a cylindrical sleeve member extends from said short leg portion around said aperture toward said one of said batteries, said cylindrical sleeve fitting around said positive post.

4. A flashlight in accordance with claim 2 wherein said portion of said switch member comprises a long leg portion terminating in a tongue extending toward said conductive portion of the other of said batteries.

5. A flashlight in accordance with claim 1 wherein one of said stop members includes a first leg portion extending outwardly of said retaining member and a second leg portion extending between said arm members and bearing on the end wall of said one of said batteries.

6. A flashlight in accordance with claim 5 wherein said other of said stop members includes a single leg portion extending between said arm members and bearing on the end of the side wall of said other of said batteries.

7. A flashlight in accordance with claim 6 wherein said second leg portion extends from said first leg portion at a point spaced from the end of said battery retaining member a distance approximately equal to the distance between the end of said battery retaining member and the end of the positive post of said one battery.

* * * * *